United States Patent [19]

Brundage

[11] Patent Number: 4,529,117

[45] Date of Patent: Jul. 16, 1985

[54] BLANK FOR HEAVY DUTY PAPERBOARD VEGETABLE CARTON

[75] Inventor: David J. Brundage, Salinas, Calif.

[73] Assignee: Champion International Corporation, Stamford, Conn.

[21] Appl. No.: 583,285

[22] Filed: Feb. 27, 1984

Related U.S. Application Data

[63] Continuation of Ser. No. 382,135, May 26, 1982, abandoned.

[51] Int. Cl.[3] ..... B65D 5/48

[52] U.S. Cl. ..... 229/27; 206/602; 229/16 R; 229/44 R; 229/DIG. 11

[58] Field of Search ..... 229/16 R, 16 C, 6 R, 229/6 A, 15, 27, 23 R, 23 BT, DIG. 11, 44 R; 206/602

[56] References Cited

U.S. PATENT DOCUMENTS

| | | | |
|---|---|---|---|
| 1,668,800 | 5/1928 | Bonfield | 229/27 X |
| 2,277,403 | 3/1942 | Horr | 229/23 R X |
| 2,698,125 | 12/1954 | Vizcarrondo et al. | 229/27 |
| 2,834,530 | 5/1958 | Nute | 229/15 X |
| 2,913,162 | 11/1959 | Goltz | 229/27 |
| 2,979,250 | 4/1961 | Hobbs | 229/DIG. 11 |
| 3,099,380 | 7/1963 | Nathan | 229/27 |
| 3,343,660 | 9/1967 | Bailey | 229/44 R X |
| 3,695,505 | 10/1972 | Wolf | 229/27 X |
| 3,871,569 | 3/1975 | Wharton, Jr. | 229/15 |
| 4,105,152 | 8/1978 | Elward | 229/23 BT |
| 4,134,533 | 1/1979 | Heavner | 229/DIG. 11 |
| 4,175,691 | 11/1979 | Cornell et al. | 229/23 R X |
| 4,372,476 | 2/1983 | Harned et al. | 229/16 R X |

FOREIGN PATENT DOCUMENTS

| | | | |
|---|---|---|---|
| 762358 | 11/1956 | United Kingdom | 229/27 |

*Primary Examiner*—William Price
*Assistant Examiner*—Gary E. Elkins
*Attorney, Agent, or Firm*—Evelyn M. Sommer; John H. Mulholland; William W. Jones

[57] ABSTRACT

A heavy duty corrugated paperboard vegetable container formed from a one-piece blank. The container has a tapered cross-sectional configuration adapted for containing vegetables, such as asparagus or the like and is internally sub-divided into equal size compartments. The container is used for shipping vegetables, and may be cut in half without destroying its structural integrity.

7 Claims, 5 Drawing Figures

BLANK FOR HEAVY DUTY PAPERBOARD VEGETABLE CARTON

This application is a continuation of application Ser. No. 382,135, filed May 26, 1982, now abandoned.

This invention relates to a blank for a heavy duty corrugated paperboard vegetable carton for storing and transporting fresh vegetables.

Corrugated paperboard cartons used for storing and transporting fresh vegetables and other produce must be durable, easy to assemble and readily stackable. Cartons of this type have been proposed which are made from one, two or three-piece blanks which are pre-cut and scored to be erected into the carton. For simplicity and ease of assembly, the one-piece blank is greatly preferred over the multiple piece blanks. Another desirable feature of inclusion in this type of carton is internal divider walls or panels which serve to divide the interior of the carton into separate chambers. Finally, the interior cross-sectional configuration of specialized ones of such cartons may be desirably trapezoidal due to the peculiar shapes of the produce to be packed in them, as for example, asparagus or the like.

Representative patents disclosing paperboard produce cartons are: U.S. Pat. No. 1,668,800, issued May 8, 1928 to E. W. Bonfield; No. 2,743,050, issued Apr. 24, 1956 to W. B. Crane; No. 3,099,380, issued July 30, 1963 to I. E. Nathan; No. 3,194,472, issued July 13, 1965 to W. B. Crane; and No. 3,695,505, issued Oct. 3, 1972 to D. G. Wolf.

Certain of the prior art cartons shown in the above-noted patents are constructed with interiors which are trapezoidal in cross-sectional configuration by means of several different constructions. For example, U.S. Pat. Nos. 2,743,050 and 3,194,472 to Crane and 3,695,505 to Wolf use auxiliary inner wall panels to provide a trapezoidal interior in a carton which has a rectangular exterior. U.S. Pat. No. 1,668,800 to Bonfield uses trapezoidal end walls to provide a carton having both interior and exterior of trapezoidal cross-section.

As previously noted, cartons with trapezoidal cross-sectional interiors are particularly suited for packing of asparagus since this configuration lends itself to the tapered shape of the asparagus plant. The preferable trapezoidal configuration for packing asparagus is with the longer parallel edge of the trapezoid at the bottom of the carton, and the shorter parallel edge at the top. This provides inwardly tapered side walls on the carton which ensures positive retention of the asparagus or other produce in the carton. This configuration, however, creates a problem when packing the asparagus into the carton when the packing is performed through the open top of the carton, since the axes of the asparagus stalks extend vertically of the carton, and since the asparagus stalks taper and are relatively fragile.

The carton of this invention provides an improved, durable construction, which is formed from a one-piece blank of corrugated paperboard, and which is internally divided into at least two compartments. The carton has an internal trapezoidal cross-section with the longer parallel edge being at the bottom of the carton and the shorter parallel edge at the top. The carton has a pivoting front wall panel which is left open after the carton has been partially erected so that the compartments of the carton can be filled with produce from the front of the carton. Thus the difficulty of filling the trapezoidally configured carton is eliminated. After filling, the front wall panel is pivoted up into its operative position and secured to the remainder of the carton thereby completing formation of the trapezoid and securing the produce in place in the carton.

It is, therefore, an object of this invention to provide an improved blank for a corrugated paperboard carton for retaining and transporting fresh produce.

It is an additional object of this invention to provide a blank for forming a carton of the character described having a trapezoidal internal cross section with the longer parallel edge of the trapezoid at the bottom of the carton to snugly retain the produce in the carton.

It is a further object of this invention to provide a blank for forming a carton of the character described which has internal divider panels operable to subdivide the interior of the carton into at least two compartments.

It is still another object of this invention to provide a blank for forming a carton of the character described which has a pivotable front wall panel which can be pivoted to an open position whereby the carton can be filled with produce from the front.

These and other objects and advantages of the invention will become more readily apparent from the following detailed description of a preferred embodiment of a carton formed in accordance with the invention taken in conjunction with the accompanying drawings, in which.

Figure 1:
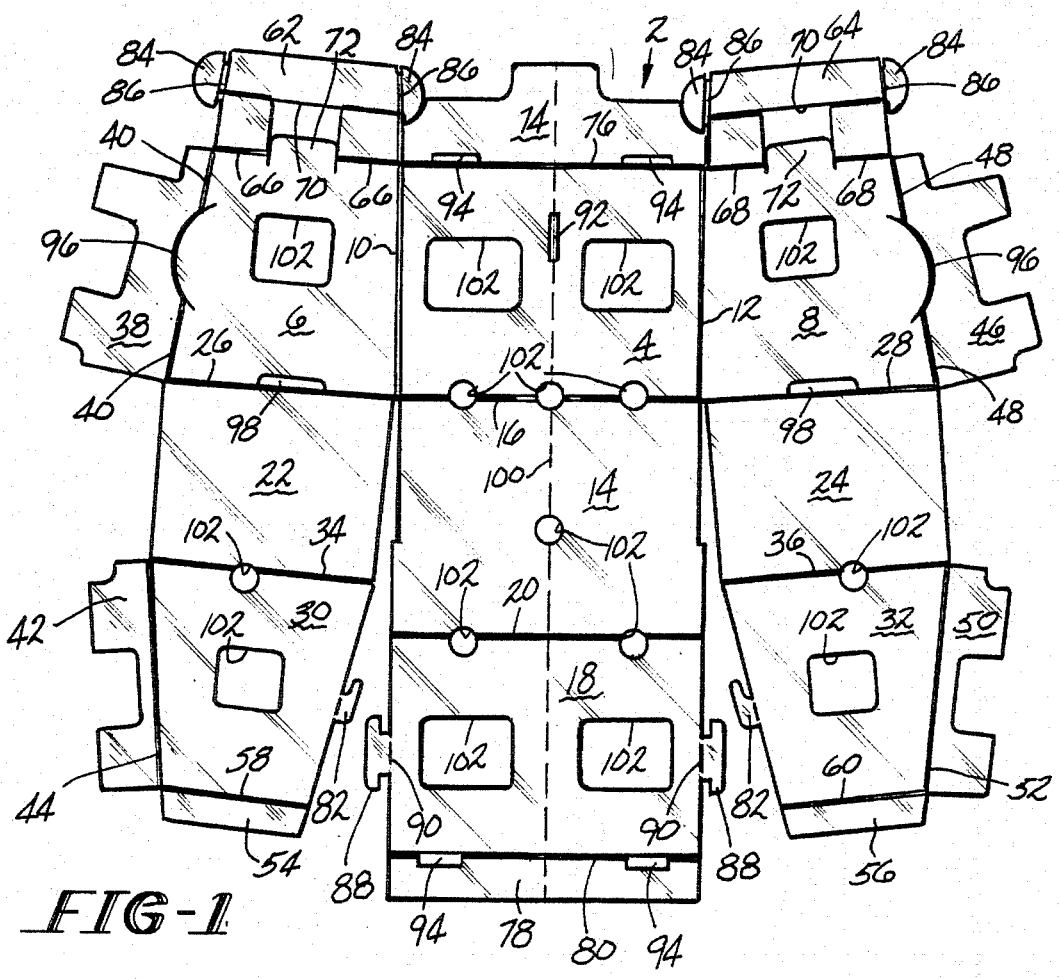
FIG. 1 is a plan view of a preferred embodiment of a one piece cut and scored corrugated paperboard blank from which a preferred embodiment of a carton formed in accordance with this invention can be erected.

Referring now to the drawings, there is shown in FIG. 1 a preferred embodiment of a corrugated paperboard blank which is precut and scored and from which a preferred embodiment of a carton formed in accordance with this invention is erected. The blank, denoted generally by the numeral 2, includes a back wall panel 4 to which there are foldably connected trapezoidal end wall panels 6 and 8, the panels 6 and 8 being connected to the back wall panel 4 by means of fold lines 10 and 12 respectively. An outer bottom wall panel 14 is connected to the back wall panel 4 of substantially equal width by means of a fold line 16, and a front wall panel 18 of substantially equal width is connected to the outer bottom wall panel 14 by means of a fold line 20. A pair of inner bottom wall panels 22 and 24 are connected to the end wall panels 6 and 8 respectively by means of fold lines 26 and 28. A pair of trapezoidal inner partition panels 30 and 32 are connected to the inner bottom wall panels 22 and 24 respectively by means of fold lines 34 and 36. A pivoting door or inner closure panel 38 is connected to the trapezoidal end wall panel 6 by means of a fold line 40, and a complimentary pivoting door or inner closure panel 42 is connected to the trapezoidal inner partition panel by means of a fold line 44. On the opposite side of the blank 2, a pivoting door or inner closure panel 46 is connected to the trapezoidal end wall panel 8 by means of a fold line 48, and a complimentary pivoting door or inner closure panel 50 is connected to the trapezoidal inner partition panel 32 by means of a fold line 52. A pair of medial top closure flaps 54 and 56 are connected to the trapezoidal inner partition panels 30 and 32 respectively by fold lines 58 and 60. A pair of end top closure flaps 62 and 64 are connected to the trapezoidal end wall panels 6 and 8 respectively by fold lines 66 and 68. An opening 70 is cut through the mid portion of each of the end top closure flaps 62 and 64 so as to form a projecting stacking tab 72 extending from each trapezoidal end wall panel 6 and 8. A back top closure flap 74 is connected to the back wall panel 4 by a fold line 76, and a front top closure flap 78 is connected to front wall panel 18 by a fold line 80. The fold lines 66 and 68 each intersect fold line 76 at an obtuse angle and the distance from fold line 76 to fold line 80 is more than the distance from fold line 58 to fold line 66 and fold line 60 to fold line 68 to permit the carton to be erected. A locking tab 82 is formed on the side edge of each of the inner partition panels 30 and 32. Locking tabs 84 are formed on each end of the end top closure flaps 62 and 64 and connected thereto by fold lines 86. A pair of locking tabs 88 are connected to opposite end edges of the front wall panel 18 by fold lines 90. A locking tab slot 92 is formed in the back wall panel 4, and a pair of locking tab slots 94 are formed in each of the back and front top closure flaps 74 and 78 respectively. A locking tab slot 96 is formed along the fold lines 40 and 48. A stacking tab slot 98 is formed along each fold line 26 and 28. An interrupted cut score line 100 preferably extends across the back top closure flap 74, the back wall panel 4, the outer bottom wall panel 14, the front wall panel 18, and the front top closure flap 78 so as to divide the blank 2 into opposing halves. The blank 2 is also provided with numerous venting openings 102.

Figure 2:
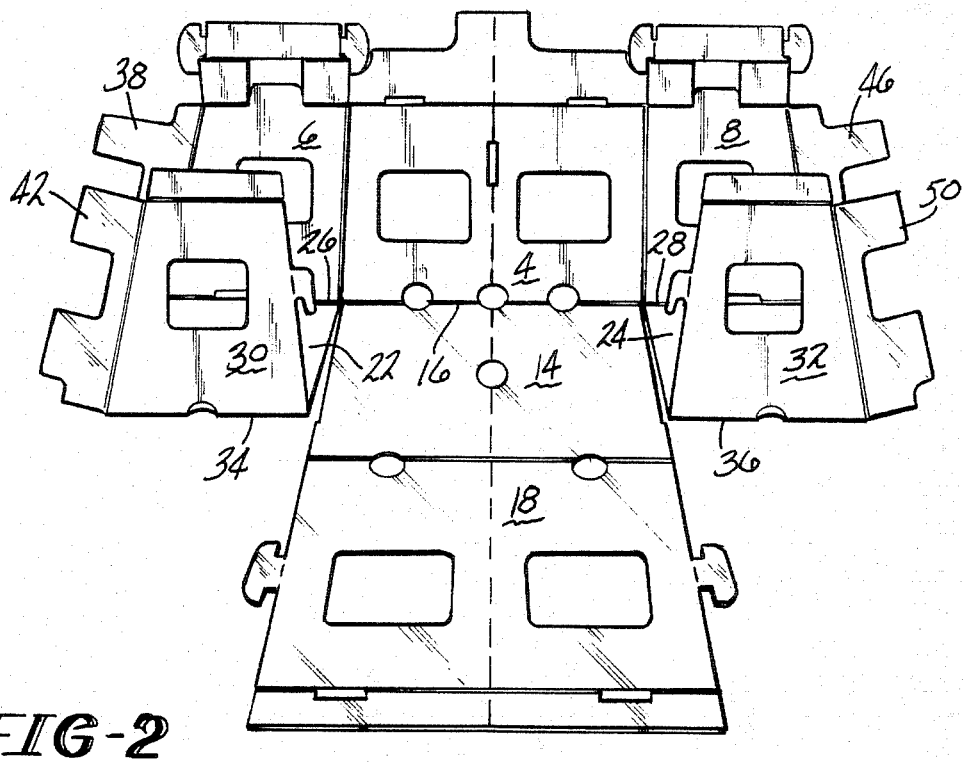
FIG. 2 is a perspective view of the blank of FIG. 1 showing an intermediate step in the erection of the blank to form a carton.

Referring now to FIG. 2, the manner in which the preliminary erecting step for forming the carton from the blank is indicated. The first step for erecting the carton is to fold the back wall panel 4 about the fold line 16 until the back wall panel 4 is perpendicular to the outer bottom wall panel 14. At the same time the trapezoidal end wall panels 6 and 8 are folded about the fold lines 26 and 28 respectively until they are perpendicular to the inner bottom wall panels 22 and 24 respectively. Then the trapezoidal inner partition panels 30 and 32 are folded about the fold lines 34 and 36 respectively until they are perpendicular to the inner bottom wall panels 22 and 24 respectively. At this point the intermediate stage shown in FIG. 2 is reached.

Figure 3:
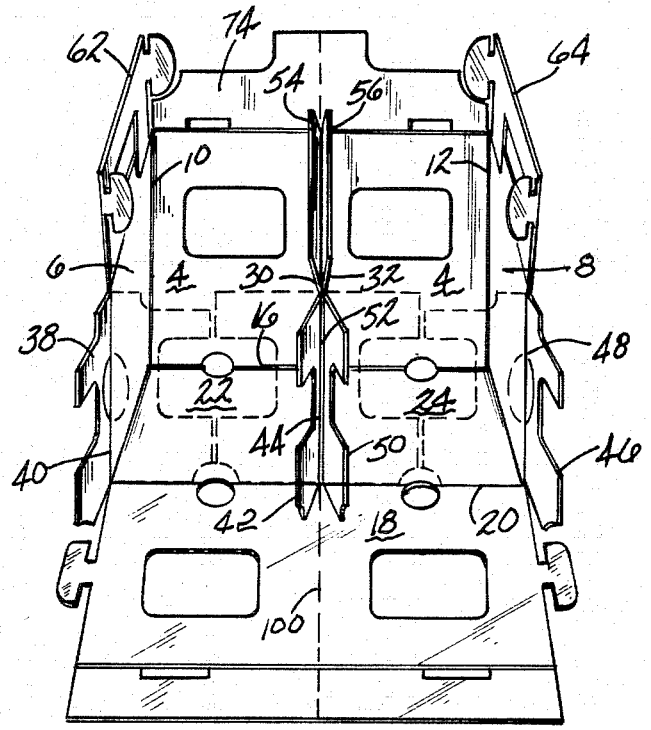
FIG. 3 is a perspective view of the partially erected carton of this invention showing the carton in the condition wherein it is ready to be filled with produce.

Referring to FIG. 3, the filling or loading stage or configuration of the carton is shown. To achieve this configuration, the trapezoidal end panels 6 and 8 are pivoted about the fold lines 10 and 12 respectively until they are perpendicular to the back wall panel 4. This movement will cause the trapezoidal partition panels 30 and 32 to be moved into face-to-face relationship with both panels 30 and 32 extending across the medial portion of the outer bottom wall panel 14, and the inner bottom wall panels 22 and 24 will be brought into overlying relationship with the outer bottom wall panel 14, thus forming a double thickness bottom wall for the carton. Trapezoidal panels 30 and 32 are then locked into position with back wall panel 4, by inserting locking tabs 82 on both trapezoidal panels 30 and 32 into locking slot 92 on back wall panel 4. It will be noted that the plane containing the interrupted cut score line 100 will lie between the opposed faces of the trapezoidal partition panels 30 and 32 and between the opposed free edges of the inner bottom wall panels 22 and 24. It will be noted that the medial top closure flaps 54 and 56, the end top closure flaps 62 and 64, and the back top closure flap 74 all extend upwardly, while the door or inner closure panels 38 and 46 extend outwardly substantially coplanar with the trapezoidal end wall panels 6 and 8 respectively, and the door or inner closure panels 52 and 50 extend outwardly substantially coplanar with the trapezoidal partition panels 30 and 32 respectively. Thus the space between the trapezoidal end wall panel 6 and the trapezoidal partition panel 30, and the space between the trapezoidal end wall panel 8 and the trapezoidal partition panel 32 is completely open and accessible from the front so that the produce and be packed or loaded into the carton from the front.

When the carton is loaded, it can be placed on a horizontal, flat surface, or it can be placed in a V-shaped trough-like support with the fold line 16 being disposed at the nadir of the support. The carton will thus be tilted at an angle for filling, It will be appreciated that the carton can thus be conveniently and quickly loaded with produce via the the open front. When asparagus is loaded into the carton, the stalks are vertically oriented with the tips of the asparagus stalks being uppermost to accommodate the taper of the stalks, to the trapezoidal cross sectional configuration of the carton. After the two compartments are filled with produce, the pivoting door or inner closure panels 38, 42, 46 and 50 are swung 90° about the fold lines 40, 44, 48 and 52 respectively to the positions shown in phantom in FIG. 3. This movement sweeps the produce snugly into the compartments.

Figure 4:
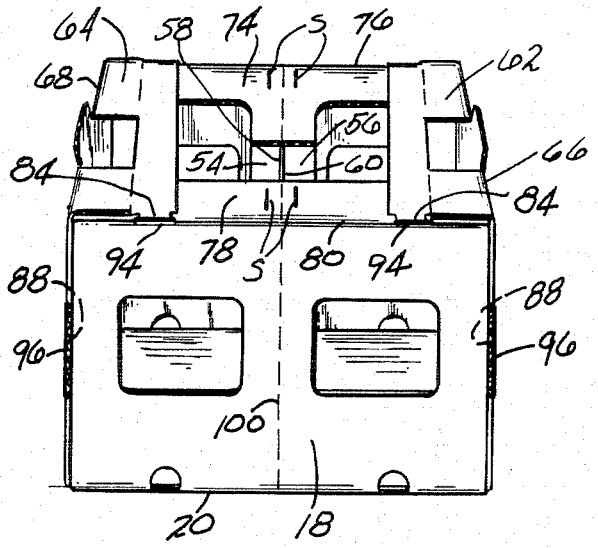
FIG. 4 is a perspective view of the erected and closed carton.
Figure 5:
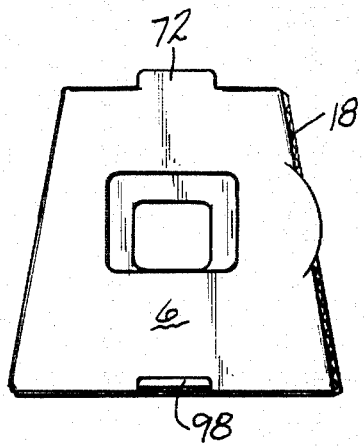
FIG. 5 is a side elevational view of the erected carton showing the trapezoidal cross sectional configuration of the carton.

The remainder of the panels and flaps are then folded to form the closed carton shown in FIG. 4. Specifically, the front wall panel 18 is folded upwardly about the fold line 20 until it overlies the door or inner closure panels 40, 42, 46 and 50 and the locking tabs 88 are inserted into the locking tab slots 96 to hold the front wall panel 18 in place. The medial top closure flaps 54 and 56 are folded downwardly about the fold lines 58 and 60 respectively and the top closure flaps 74 and 78 are folded down about the fold lines 76 and 80 respectively to overlie the medial top closure flaps 54 and 56. The end top closure flaps 62 and 64 are then folded down about the fold lines 66 and 68 respectively to overlie the back and front top closure flaps 74 and 78 respectively and the locking tabs 84 are inserted into the locking tab slots 94 to secure the top closure flaps in place. Staples S may then be secured through the flaps 74, 78, 54 and 56 adjacent the interrupted cut score line 100 to permit the carton to be severed in two separate structural units along the cut score line 100 if desired subsequent to packing. It will be noted that the stacking tabs 72 project upwardly above the plane of the top of the carton so as to be receivable in the stacking slots 98 of a second carton placed atop the first carton whereby the cartons can be securely stacked on top of each other. This feature is clearly shown in FIG. 5 of the drawings, as is the trapezoidal cross sectional configuration of the erected carton.

It will be readily appreciated that the carton of this invention employs the desirable trapezoidal cross sectional configuration, yet it can be easily packed with produce without interference from the inwardly and upwardly tapering side walls. The carton also includes the desirable multi compartment interior and can readily be separated into independently usable sub-cartons, if the need should arise. The carton is of suitable strength, and is formed from a one-piece blank of corrugated paperboard which can be quickly and easily erected to the necessary form of holding produce.

Since many changes and variations of the disclosed embodiment of the invention may be made without departing from the inventive concept, it is not intended to limit the invention otherwise than as required by the appended claims.

What is claimed is:

1. A flat unitary corrugated paperboard blank for forming a vegetable carton, said blank including panels identified by their ultimate position and function in the carton and/or their shape, said blank comprising:

top front flap, rectangular front panel, rectangular outer bottom panel, rectangular back panel and top back flap all of substantially equal width and consecutively articulated to one another along parallel fold lines, said front and back panels being of substantially identical size and shape;

substantially identical trapezoidal first and second end panels articulated to said back panel along parallel fold lines, the fold lines between said back panel and said trapezoidal first and second end panel being substantially perpendicular to the fold line between said back panel and said outer bottom panel;

first and second top end flaps articulated to said first and second trapezoidal end panels along fold lines that intersect the fold line between the back panel and the top back flap at an obtuse angle;

first and second substantially identical rectangular inner bottom panels articulated respectively to the first and second trapezoidal end panels along fold lines that intersect the fold line between the back panel and the outer bottom panel at an obtuse angle and that are parallel to but longer than the fold lines between the corresponding first or second end panel and its respective top end flap, the fold lines between said first and second trapezoidal end panels and the corresponding first or second inner bottom panels being substantially equal in length to the distance between said front and back panels; and first and second trapezoidal inner partition panels articulated respectively to said first and second inner bottom panels along fold lines that are respectively parallel to and equal in length to the foldable connections between the corresponding first or second inner bottom panel and the respective trapezoidal end panel, said trapezoidal inner partition panels being substantially identical in size and shape to said first and second trapezoidal end panels, the distance from the fold lines at the top of the first and second trapezoidal end panels intersecting the fold line between the back panel and the top back flap at an angle and the corresponding top edge defining line of the corresponding first or second trapezoidal inner partition panel being less that the distance from the fold line between the top front flap and the rectangular front panel and the fold line between the rectangular back panel and top back flap whereby said blank may be erected to form a carton of substantially trapezoidal cross section for storing vegetables.

2. A blank as in claim 1 further including first and second door panels articulated respectively to said first and second trapezoidal end panels along fold lines that are spaced from but not parallel to the respective foldable connections between said back panel and said first and second end panels.

3. A blank as in claim 2 further including third and fourth door panels articulated respectively to said first and second inner partition panels along the edges thereof most distant from said front and outer bottom panels.

4. A blank as in claim 3 further including locking tabs articulated to said front panel along fold lines which are aligned substantially perpendicular to the fold lines between said front panel and said outer bottom panel and said top front flap and wherein said first and second end flaps include locking tab slots substantially adjacent to the fold line between said first and second end panels and said first and second door panels.

5. A blank as in claim 4 further including a pair of top locking tabs articulated to each of said top end flaps, a first pair of top locking slots disposed in the top back flap adjacent said back panel, and a second pair of top locking slots formed in said top front flap adjacent said front panel, said top locking slots being dimensioned to engage the top locking tabs on the carton erected from the blank.

6. A blank as in claim 4 further including partition locking tabs articulated respectively to each said first and second trapezoidal inner partition panel along the edges thereof nearest said front panel, said back panel being provided with a partition locking slot dimensioned to engage each the partition locking tabs on the carton erected from the blank.

7. A blank as in claim 4 further including a pair of stacking tabs defined by a plurality of cut lines in each said top end flap and rigidly extending from each of said first and second end panels, said first and second end panels being further defined by stacking slots disposed adjacent to said first and second inner bottom panels respectively, whereby the stacking slots on a carton erected from the blank can lockingly engage the stacking tabs on another carton of similar construction.

* * * * *